US009121652B1

(12) United States Patent
Mangiameli

(10) Patent No.: US 9,121,652 B1
(45) Date of Patent: Sep. 1, 2015

(54) FIREARM HAVING A MAGAZINE PERMANENTLY AFFIXED THERETO

(71) Applicant: David P. Mangiameli, Center Moriches, NY (US)

(72) Inventor: David P. Mangiameli, Center Moriches, NY (US)

( * ) Notice: Subject to any disclaimer, the term of this patent is extended or adjusted under 35 U.S.C. 154(b) by 0 days.

(21) Appl. No.: 14/095,479

(22) Filed: Dec. 3, 2013

(51) Int. Cl.
*F41A 9/66* (2006.01)
*F41A 9/64* (2006.01)

(52) U.S. Cl.
CPC ..... *F41A 9/64* (2013.01)

(58) Field of Classification Search
CPC ..... F41A 9/65; F41A 17/36; F41A 9/66; F41A 9/67
USPC ..... 42/49.01, 17, 18, 33, 6, 49.02, 50
See application file for complete search history.

(56) References Cited

U.S. PATENT DOCUMENTS

| | | | | | |
|---|---|---|---|---|---|
| 1,500,580 | A | * | 7/1924 | Fererro | 42/50 |
| 2,910,795 | A | * | 11/1959 | Agren | 42/50 |
| 3,977,114 | A | | 8/1976 | Poor | |
| 4,016,667 | A | * | 4/1977 | Forbes | 42/6 |
| 4,430,821 | A | * | 2/1984 | Vincent | 42/50 |
| 4,614,052 | A | * | 9/1986 | Brown et al. | 42/87 |
| 4,688,344 | A | * | 8/1987 | Kim | 42/50 |
| 4,862,620 | A | | 9/1989 | Chestnut et al. | |
| 5,309,660 | A | * | 5/1994 | Blackamore | 42/50 |
| 5,452,534 | A | * | 9/1995 | Lambie | 42/18 |
| 5,685,101 | A | * | 11/1997 | Ferretti | 42/18 |
| 5,806,224 | A | * | 9/1998 | Hager | 42/18 |
| 7,200,964 | B2 | * | 4/2007 | Gates | 42/50 |
| 7,497,044 | B2 | * | 3/2009 | Cammenga et al. | 42/50 |
| 8,061,071 | B2 | | 11/2011 | Fitzpatrick et al. | |
| 8,322,063 | B1 | | 12/2012 | Battaglia | |
| 8,356,439 | B2 | | 1/2013 | Dubois | |
| 8,468,730 | B2 | * | 6/2013 | Faifer et al. | 42/50 |
| 8,484,877 | B2 | | 7/2013 | Zimmerman | |
| 2004/0020092 | A1 | * | 2/2004 | Christensen | 42/49.01 |
| 2007/0033850 | A1 | | 2/2007 | Murello et al. | |
| 2010/0281731 | A1 | * | 11/2010 | Stone | 42/6 |

* cited by examiner

*Primary Examiner* — Samir Abdosh
*Assistant Examiner* — John D Cooper
(74) *Attorney, Agent, or Firm* — Caesar Rivise, PC

(57) ABSTRACT

A firearm having a permanently affixed magazine is provided, including a receiver assembly having a receiver. The magazine is for storing and feeding cartridges into the chamber of the firearm. An upper component of the magazine is permanently secured in the receiver. A lower component is rotatably attached to the upper component at a hinge or the lower component is accessible through an aperture. When the hinged lower component is open relative to the upper component, access to a cartridge cavity is provided. Alternatively, access to the cartridge cavity in the lower component is provided by an aperture in the lower component. When the lower component is closed relative to the upper component, or when the aperture is closed, cartridges may pass from the lower component to the upper component and are ready for firing. A magazine is also provided having these features is also provided.

10 Claims, 10 Drawing Sheets

FIREARM HAVING A MAGAZINE PERMANENTLY AFFIXED THERETO

BACKGROUND OF THE INVENTION

The present invention is directed generally to firearms. More particularly, the present invention is directed to rifles having magazines for feeding cartridges to the chamber of the rifle.

Usually, the term "assault rifle" refers to a semi-automatic rifle possessing certain cosmetic and/or ergonomic features that are typical of military rifles. Semi-automatic firearms fire one cartridge each time the trigger is pulled, eject the spent cartridge casing and chamber another cartridge, all without the necessity to manually operate, for example, a bolt handle, a lever, a slide, or the like. Often, an assault weapon is defined as having a detachable magazine, along with features such as a flash suppressor, bayonet mount, and a collapsing stock.

The precise definition of the term "assault rifle" varies where different jurisdictions limit or prohibit assault weapon manufacturing, importation, sale, or possession. One of the ways jurisdictions may define the term "assault rifle" is whether the rifle has a detachable magazine. With a detachable magazine, a user may carry numerous fully loaded magazines such that the user may fire an unlimited number of cartridges without the tedious need to load one cartridge at a time. The ability to use numerous fully loaded magazines without reloading cartridge by cartridge is often considered unnecessary for non-military use.

The present invention is directed to a conversion for existing rifles (or a rifle built in a factory) that may otherwise be classified as an assault rifle due to its ability to use detachable magazines. The conversion changes the rifle to one having a non-detachable magazine such that the rifle is not classified as an assault rifle.

In rifles having a detachable magazine, the magazine must be separate from the rifle to fill the magazine with cartridges. The magazine is then inserted into the receiver of the rifle. See FIGS. 2, 3 and 4 which show a portion of a prior art firearm receiver assembly with a magazine installed in the receiver assembly, a magazine detached from the receiver assembly, and a magazine being reloaded with cartridges. Components within the receiver then use the cartridges from the detachable magazine sequentially in a firing sequence to chamber and fire cartridges, as the rifle is repeatedly fired. The detachable magazine is either detached and refilled or replaced with another full detachable magazine so continued firing can ensue. Detachable magazines can be repeatedly refilled as needed.

Such detachable magazines for firearms have been known for many years. For example, U.S. Pat. No. 8,484,877 (Zimmermann) is directed to a rifle upper receiver with integral magazine well. The receiver includes an elongate U-shaped channel. The interior of the channel has elements formed at surfaces of an extrusion. The surfaces of the extrusion provide guidance for a magazine and trigger guard assembly pins.

U.S. Pat. No. 8,061,071 (Fitzpatrick et al.) is directed to a high capacity non-drum magazine for a firearm. The magazine comprises a broad, general storage area capable of holding four staggered stacks of ammunition. The magazine has a central partition separating two dual staggered round stacks.

U.S. Patent Application Publication No. 2007/0033850 (Murello et al.) is directed to a firearm receiver with a hollow body profile. The hollow body profile is formed as an injection molded portion wherein the hollow body profile is integral with and reinforces the receiver.

U.S. Pat. No. 4,862,620 (Chesnut et al.) is directed to a magazine in a double column configuration with minimal magazine width and length requirements.

U.S. Pat. No. 3,977,114 (Poor) is directed to a rifle magazine for dispensing cartridges that has a two-piece follower.

U.S. Pat. No. 8,356,439 (Dubois) is directed to a lightweight, low cost rifle magazine fabricated from injection-molded polymers, U.S. Pat. No. 8,322,063 (Battaglia) is directed to a magazine for a rifle in which removable follower feed cartridges out of the magazine.

All references cited herein are incorporated herein by reference in their entireties.

BRIEF SUMMARY OF THE INVENTION

In a first exemplary embodiment of the present invention, a firearm, such as a rifle, having a permanently affixed magazine is provided. The rifle includes a receiver assembly having a barrel end, a butt end, a top, and a receiver end. A barrel is affixed to the barrel end of the receiver assembly. The barrel has a chamber for receiving cartridges. A receiver is disposed on the receiver end of the receiver assembly. The magazine is for storing and feeding cartridges into the chamber of the barrel. The magazine includes an upper component permanently secured in the receiver and having an open feed end disposed adjacent to the chamber of the barrel for feeding cartridges to the chamber. The upper component has an internal cavity for receiving cartridges. A lower component is attached to the upper component at a hinge, wherein the lower component is rotatable from an open position wherein access to a cartridge cavity in the lower component is provided, to a closed position wherein the lower component is secured to the upper component and wherein the cartridge cavity in the lower component aligns with the internal cavity of the upper component, such that cartridges may pass from the cartridge cavity of the lower component to the internal cavity of the upper component. The lower component is rotatable at the hinge with respect to the upper component, from the open position for reloading the cartridge cavity of the lower component of the magazine with cartridges, to the closed position for feeding cartridges from the lower component, through the upper component and into the chamber, for firing the cartridge.

The magazine preferably has a spring disposed in it for urging cartridges in the magazine towards the chamber of the barrel. The spring has a first end disposed against a lower end of the lower component of the magazine, and a second end disposed against a follower. When the magazine is in the closed position, the spring is at least a partially uncompressed to extend the follower through the cartridge cavity in the lower component and through the internal cavity of the upper component. A topmost cartridge of the cartridges is urged towards the chamber. When the magazine is in the open position, the spring is compressed entirely within the lower component of the magazine and captured, for reloading the lower component with cartridges.

A spring catch may releasably secure the spring and follower within the lower component of the magazine such that, when the spring and follower are secured by the spring catch into the lower component, the magazine is movable from its closed position to its open position without interference from the spring or follower such that the lower component is reloadable with cartridges. When the spring and follower are not secured by the spring catch, the spring is at least partially uncompressed such that the follower is urged by the spring into the upper component of the magazine.

A substantially inelastic cord having a first end and a second end may be provided where the first end is secured to the follower and the second end is adapted to be pulled to place tension on the cord in a direction to cause the spring to compress and the follower to retract into the cartridge cavity of the lower component. The cord may extend from the follower to a lower portion of the lower component of the magazine to a catch to secure the follower in the cartridge cavity, wherein when the lower component of the magazine is in the closed position, the spring catch is releasable such that the spring is at least partially uncompressed and the follower is urged by the spring into the upper component of the magazine.

In an alternate exemplary embodiment of the present invention, a firearm having a permanently affixed magazine is provided that includes a receiver assembly having a barrel end, a butt end, a top, and a receiver end. A barrel is affixed to the barrel end of the receiver assembly where the barrel has a chamber for receiving cartridges. A receiver is disposed on the receiver end of the receiver assembly. The magazine for storing and feeding cartridges into the chamber of the barrel is provided where the magazine is permanently secured to the receiver. The magazine includes an upper component disposed in the receiver which has an open feed end disposed adjacent to the chamber of the barrel for feeding cartridges to the chamber, and an internal cavity for receiving cartridges. The magazine has a lower component integral to the upper component, such that cartridges may pass from a cartridge cavity of the lower component to the internal cavity of the upper component. An aperture in the lower component of the magazine is provided for feeding cartridges into the magazine. A spring is provided for urging cartridges in the magazine towards the chamber of the barrel. The spring has a first end disposed against a lower end of the lower component of the magazine, and a second end disposed against a follower. The spring is at least partially uncompressed and extends through the cartridge cavity of the lower component of the magazine and through the internal cavity of the upper component. Upon firing of the firearm, a topmost cartridge of the cartridges is urged towards the chamber for feeding into the chamber, and the spring is capturable entirely within the lower component of the magazine, wherein the magazine is accessible for reloading of cartridges through the aperture.

A spring catch may be provided to releasably secure the spring and follower within the lower component of the magazine such that the lower component is reloadable with cartridges, and, when the spring and follower are not secured by the spring catch, the spring is at least partially uncompressed such that the follower is urged by the spring into the upper component of the magazine. A substantially inelastic cord may be provided having a first end and a second end. The first end is secured to the follower and the second end is adapted to be pulled to place tension on the cord in a direction to cause the follower to retract into the cartridge cavity of the lower component.

The cord may extend from the follower to a lower portion of the lower component of the magazine to a spring catch to removably secure the follower in the cartridge cavity. The spring catch is releasable such that the spring is at least partially uncompressed and the follower is moveable within the upper portion of the magazine to a point adjacent to the chamber. The cord may extend from follower to the lower portion of the cavity up to a point adjacent to an upper end of the lower portion to the spring catch. A hinged cover for covering the aperture may be provided. Alternatively, a hinged channel for accessing the aperture for feeding cartridges into the magazine may be provided. Here, the hinged channel is moveable from a closed position wherein the channel forms a portion of the cartridge cavity of the lower component, to an open position wherein the aperture is accessible for feeding cartridges into the lower component of the magazine by a user.

A magazine for storing and feeding cartridges into a chamber of a firearm in accordance with another exemplary embodiment is also provided, including an upper component having an open feed end disposed for feeding cartridges and an internal cavity for receiving cartridges. A lower component is rotatably attached to the upper component at a hinge. The lower component is rotatable from an open position wherein access to a cartridge cavity in the lower component is provided, to a closed position wherein the lower component is secured to the upper component and the cartridge cavity in the lower component aligns with the internal cavity of the upper component. Cartridges may pass from the cartridge cavity of the lower component to the internal cavity of the upper component. The lower component is rotatable at the hinge with respect to the upper component, from the open position for reloading the cartridge cavity of the lower component of the magazine with a plurality of cartridges, to the closed position for feeding cartridges from the lower component, through the upper component, for firing the cartridge.

The magazine preferably has a spring disposed therein for urging cartridges in the magazine towards the open feed end of the magazine. The spring has a first end disposed against a lower end of the lower component of the magazine, and a second end disposed against a follower, wherein, when the magazine is in the closed position, the spring is at least a partially uncompressed to extend the follower through the cartridge cavity in the lower component and through the internal cavity of the upper component, wherein, a topmost cartridge of the plurality of cartridges is urged towards the open feed end. When the magazine is in the open position, the spring is compressed entirely within the lower component of the magazine, and captured for reloading the lower component with cartridges.

A spring catch may be provided to releasably secure the spring and follower within the lower component of the magazine such that, when the spring and follower are secured by the spring catch into the lower component, the magazine is movable from its closed position to its open position without interference from the spring or follower such that the lower component is reloadable with cartridges. When the spring and follower are not secured by the spring catch, the spring is at least partially uncompressed such that the follower is urged by the spring into the upper component of the magazine.

A substantially inelastic cord may be provided having a first end and a second end. The first end is secured to the follower. The second end is adapted to be pulled to place tension on the cord in a direction to cause the spring to compress and the follower to retract into the cartridge cavity of the lower component.

The cord may extend from the follower to a lower portion of the lower component of the magazine to a spring catch to removably secure the follower in the cartridge cavity, wherein when the lower component of the magazine is in the closed position, the spring catch is releasable such that the spring is at least partially uncompressed and the follower is urged by the spring into the upper component of the magazine.

An alternate magazine for storing and feeding cartridges into a chamber of a firearm in accordance with another exemplary embodiment is also provided. The magazine includes an upper component having an open feed end disposed for feeding cartridges and an internal cavity for receiving cartridges. The magazine includes a lower component integral to the upper component, such that cartridges may pass from a cartridge cavity of the lower component to the internal cavity of the upper component. The magazine further includes an aperture in the lower component of the magazine for feeding cartridges into the magazine and a spring for urging cartridges in the magazine towards the open feed end of the magazine. The spring has a first end disposed against a lower end of the lower component of the magazine, and a second end disposed against a follower. The spring is at least partially uncompressed and extends through the cartridge cavity of the lower component of the magazine and through the internal cavity of the upper component. Upon firing of the firearm, a topmost cartridge of the plurality of cartridges is urged towards the open feed end of the magazine. The spring is capturable entirely within the lower component of the magazine, wherein the magazine is accessible for reloading of cartridges through the aperture.

A spring catch may be provided to releasably secure the spring and the follower within the lower component of the magazine such that the lower component is reloadable with cartridges. When the spring and follower are not secured by the spring catch, the spring is at least partially uncompressed such that the follower is urged by the spring into the upper component of the magazine. A substantially inelastic cord having a first end and a second end may be provided. The first end is secured to the follower and the second end is adapted to be pulled to place tension on the cord in a direction to cause the follower to retract into the cartridge cavity of the lower component. The cord may extend from the follower to a lower portion of the lower component of the magazine to a spring catch to removably secure the follower in the cartridge cavity. The spring catch is releasable such that the spring is at least partially uncompressed and the follower is moveable within the upper portion of the magazine to the open feed end of the magazine. The cord may extend from the follower to the lower portion of the cavity up to a point adjacent to an upper end of the lower portion to the spring catch. A hinged cover for covering the aperture may be provided. The magazine may include a hinged channel having the aperture for accessing the aperture for feeding cartridges into the magazine. Here, the hinged channel is moveable from a closed position wherein the channel forms a portion of the cartridge cavity of the lower component, to an open position wherein the aperture is accessible for feeding cartridges into the lower component of the magazine.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF THE INVENTION

Figure 1:
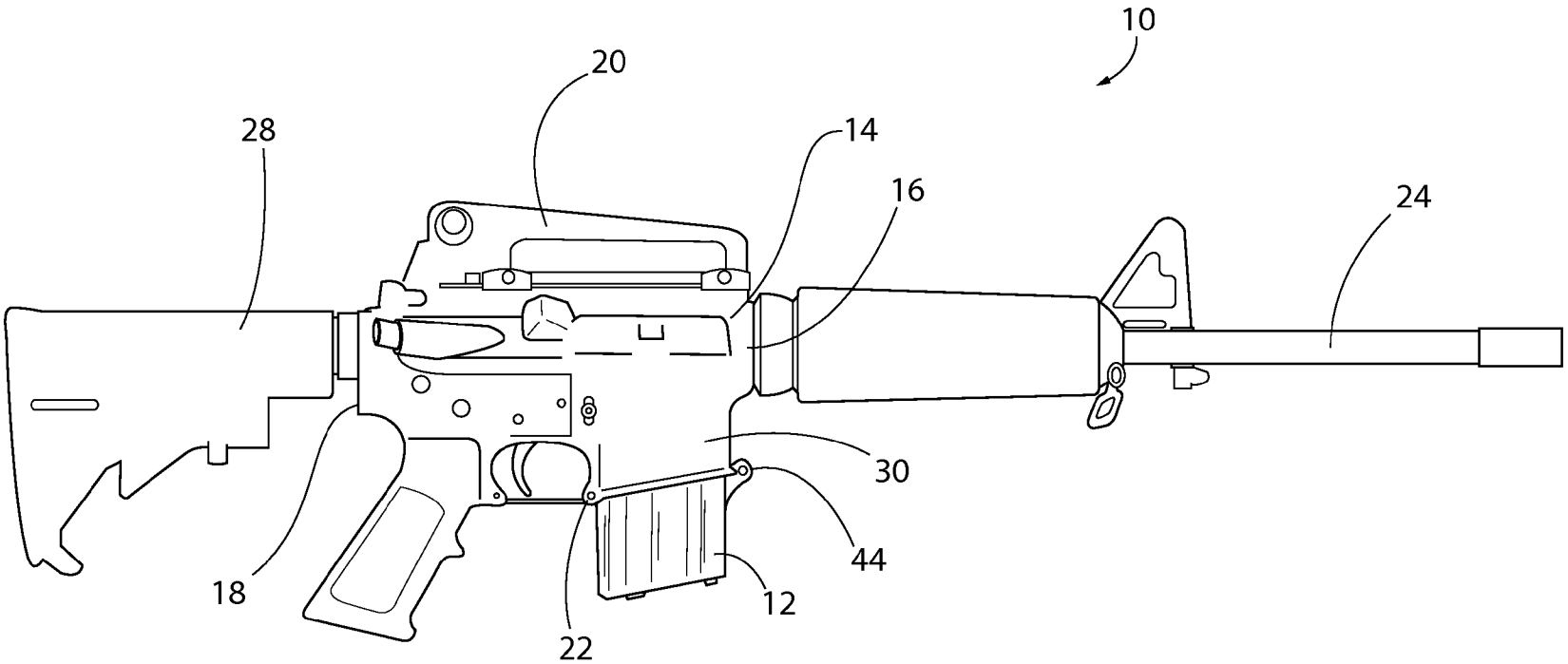
FIG. 1 is a side view of a firearm having a permanently affixed magazine in accordance with an exemplary embodiment of the present invention.

The invention will be illustrated in more detail with reference to the following embodiments, but it should be understood that the present invention is not deemed to be limited thereto. Referring now to the drawings, wherein like part numbers refer to like elements throughout the several views, there is shown in FIG. 1, a firearm 10 such as a rifle, having a magazine 12 in accordance with an exemplary embodiment of the present invention. The firearm 10 has a receiver assembly 14 that has a barrel end 16, a butt end 18 a top 20, and a receiver end 22. A barrel 24 is affixed to the barrel end 16 of the receiver assembly 14. The barrel 24 has a chamber (not shown) for receiving cartridges 26 and for firing bullets out the barrel 24. A butt stock 28 may be affixed to the butt end 18 of the receiver assembly 14. A receiver 30 for receiving the magazine 12 is disposed on the receiver end 22 of the receiver assembly 14. It is noted that in most of the drawing figures herein, only a portion of the receiver assembly 14 is shown, for clarity.

Figure 4:
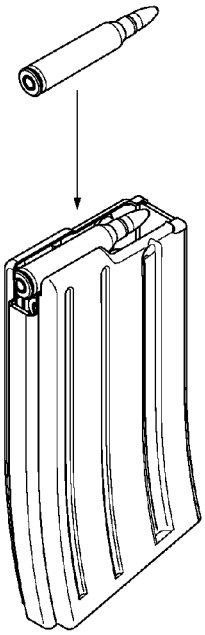
FIG. 4 (PRIOR ART)
FIG. 4 is an isometric view of a prior art magazine.
Figure 5:
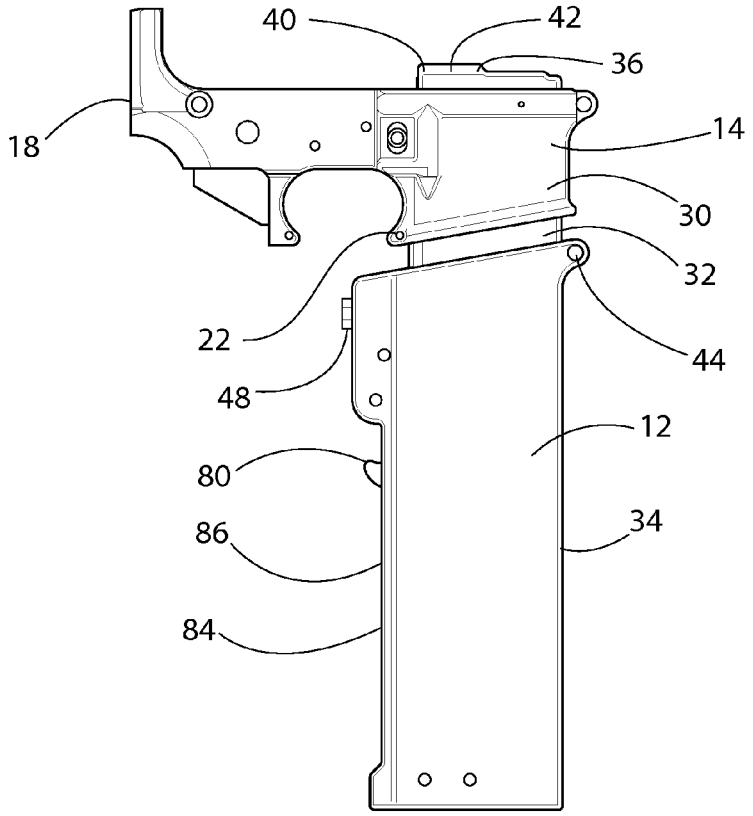
FIG. 5 is a side view of an exemplary embodiment of a receiver assembly and magazine of the firearm of FIG. 1, shown with the magazine in its closed position.
Figure 6:
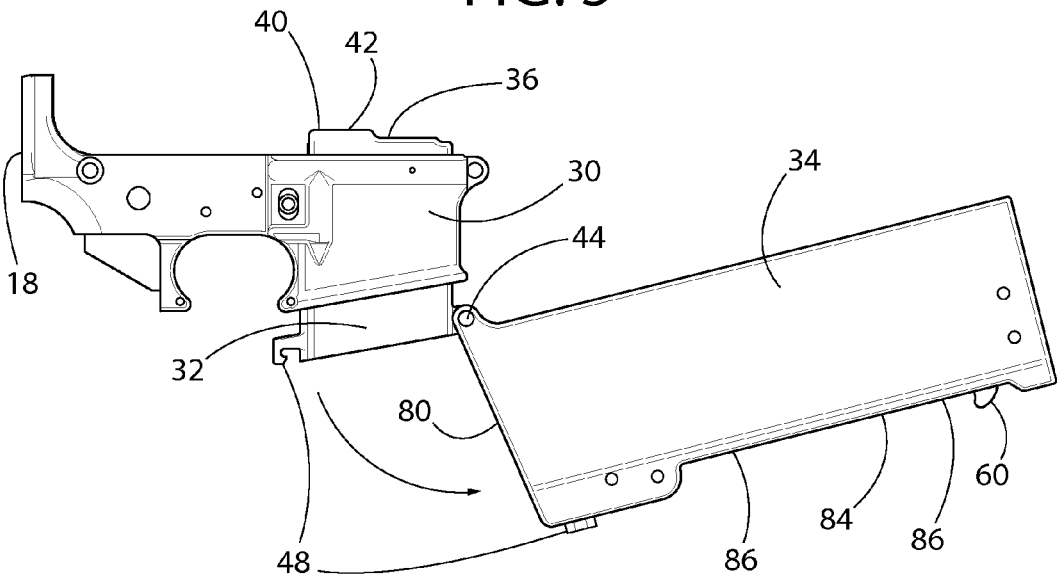
FIG. 6 is a side view of the receiver assembly and magazine of FIG. 5, shown with the magazine in its open position.
Figure 7:
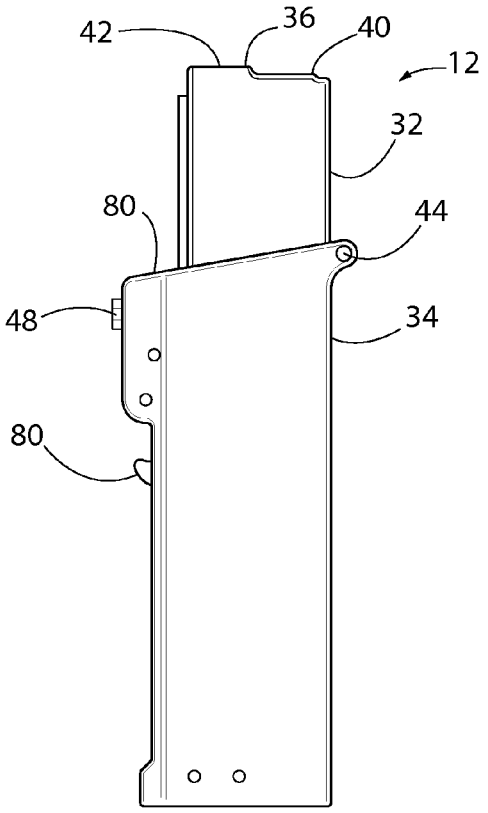
FIG. 7 is a side view of the magazine of FIG. 5.
Figure 8:
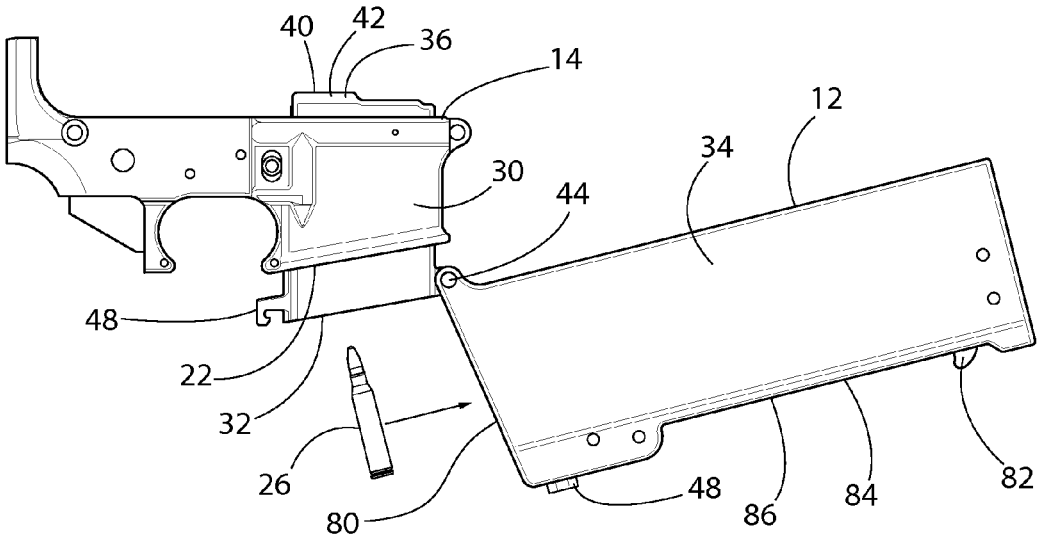
FIG. 8 is a side view of the receiver assembly and magazine of FIG. 5, shown with the magazine in an open position, and shown with a cartridge to be loaded into the magazine.

As can be seen in FIGS. 5-8, 9A, 9B and 10, the magazine 12 is provided for storing and feeding cartridges 26 into the chamber of the barrel 24 in a manner well known to those in the prior art. However, the magazine 12 is permanently secured to the receiver 30 and includes an upper component 32 and a lower component 34. For the purposes of the present invention, the terms "permanently attached," "permanently secured" and "permanently affixed" are intended to be defined as requiring more skill than a typical user would have to install or remove the magazine from the firearm, such as the skill of a gunsmith. For example, one-way screws or screws having breakaway head screws may be used to attach the magazine of the present invention to the firearm 10. The upper component 32 is disposed in the receiver 30 and has an open feed end 36 disposed adjacent to the chamber of the barrel 24 for feeding cartridges 26 to the chamber of the barrel 24. The upper component 32 has an internal cavity 38 for receiving cartridges 26 and, at the upper end 40 of the upper component 32, feeding lips 42 are provided that are substantially identical to those of a standard detachable magazine (see prior art FIG. 4). The feeding lips 42 restrict the upper end 40 of the magazine 12 so that only one bullet can be offered to the mechanism of the receiver assembly 14 that chambers and fires a cartridge 26.

In this exemplary embodiment, the lower component 34 of the magazine 12 is attached to the upper component 32 at a hinge 44. The lower component 34 is rotatable from an open position (see FIGS. 6 and 8) wherein access to a cartridge cavity 46 in the lower component 34 is provided, to a closed position (see FIGS. 5 and 7) wherein the lower component 34 is secured to the upper component 32 by a latch 48, and the cartridge cavity 46 in the lower component 34 aligns with the internal cavity 38 of the upper component 32, such that cartridges 26 may pass through from the cartridge cavity 46 of the lower component 34 to the internal cavity 38 of the upper component 32. The magazine 12 is permanently attached and is not separable from the receiver 30. The lower component 34 of the magazine 12 is rotatable relative to the upper component 32 at hinge 44, from the open position for reloading the cartridge cavity 46 of the lower component 34 of the magazine 12 with cartridges 26, to the closed position for feeding cartridges 26 from the lower component 34, through the internal cavity 38 of the upper component 32 and into the chamber of the barrel 24 for a firing sequence.

Figure 9C:
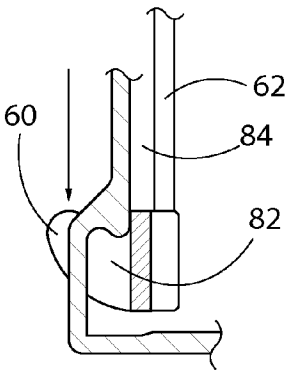
FIG. 9C is a detail view of a spring catch of the magazine of FIG. 5, for holding a spring and follower in position in a lower component of the magazine, shown in an unlatched condition.
Figure 9D:
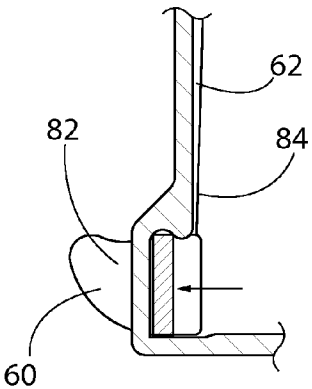
FIG. 9D is a detail view of a spring catch of the magazine of FIG. 5, for holding a spring and follower in position in a lower component of the magazine, shown in a latched condition.
Figure 9B:
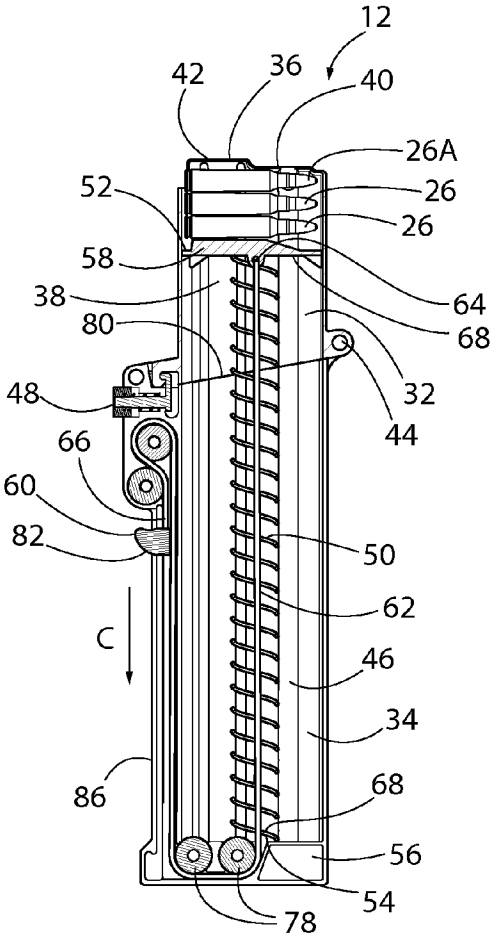
FIG. 9B is a is cross sectional side view of the magazine of FIG. 5, shown with cartridges in position at the top of the magazine, and ready for firing.
Figure 9A:
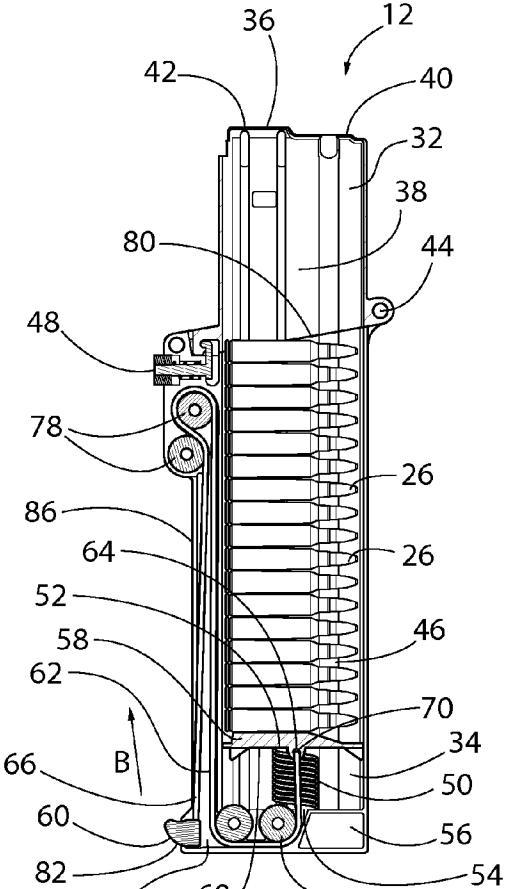
FIG. 9A is cross sectional side view of the magazine of FIG. 5, shown reloaded with cartridges, and prior to uncompressing of the spring to move the cartridges to the top of the magazine.
Figure 10:
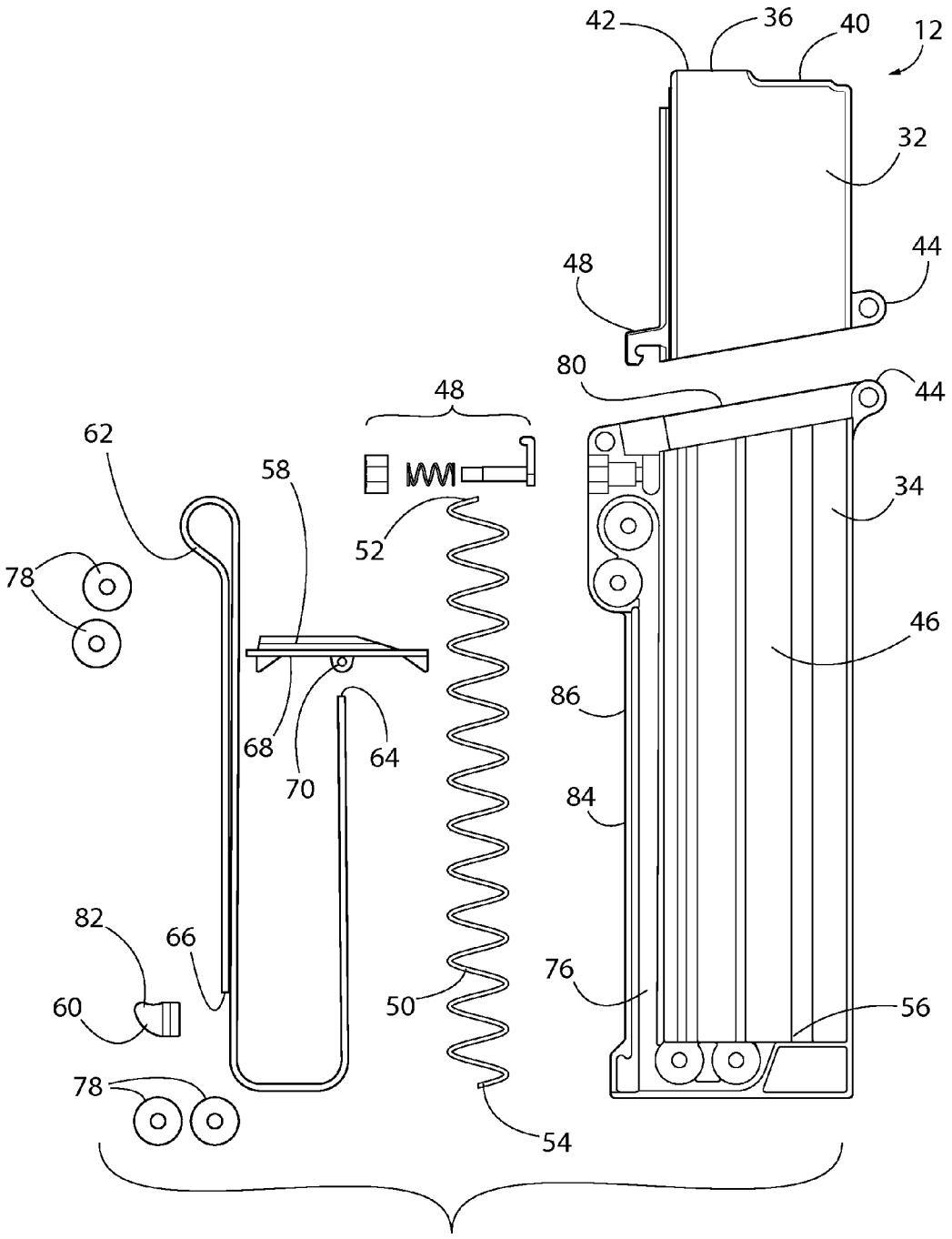
FIG. 10 is an exploded side view of the magazine of FIG. 5.

As can best be seen in FIGS. 9A, 9B and 10, the magazine 12 preferably has a spring 50 for urging cartridges 26 in the magazine 12 towards the chamber of the barrel 24, when the magazine 12 is attached to the firearm 10. The spring 50 has a first end 52 disposed against a lower end 56 of the lower component 34 of the magazine 12, and a second end 54 disposed against a moveable follower 58 wherein, when the magazine 12 is in the closed position (see FIGS. 5, 7 and 9B), the spring 50 is at least a partially uncompressed to extend through the cartridge cavity 46 in the lower component 34 and through the internal cavity 38 of the upper component 32. Upon firing of the firearm 10, a top-most cartridge 26A is urged towards the chamber of the barrel 24. When the magazine 12 is in the open position (see FIGS. 6 and 7 and the position of the spring 50 and follower 58 in FIG. 9A), the spring 50 is compressed entirely within the lower component 34 of the magazine 12, and captured such that cartridges can be reloaded into the cartridge cavity 46. The follower 58 is a plate that interfaces the spring with the bottom-most (last) bullet. The energy of the compressed spring pushes the follower 58 and the cartridges above it, upward to the top of the upper component 32.

As can be seen in FIGS. 9A, 9B, 9C and 9D, a spring catch 60 may be provided to secure the spring 50 and follower 58 within the lower component 34 of the magazine 12 such that when the spring 50 and follower 58 are secured, the magazine 12 is movable from its closed position to its open position without interference from the spring 50 and/or follower 58 such that the lower component 34 is reloadable with cartridges 26. When the spring 50 and follower 58 are not secured by the spring catch 60, the spring 50 uncompresses such that the follower 58 is urged by the spring 50 into the upper component 32 of the magazine 12.

Preferably, a substantially inelastic cord 62 (such as a thin cable, wire, string, or the like), may be attached to the follower 58. The cord 62 has a first end 64 and a second end 66. The bottom 68 of the follower 58 has an aperture 70 or other similar device on which the first end 64 of the cord 62 is attached. The second end 66 of the cord 62 extends down such that, when tension is placed on the cord 62, the follower 58 compresses the spring 50 such that the follower 58 and spring 50 retract into the cartridge cavity 46 of the lower component 34. The cord 62 preferably extends from the follower 58 to a lower portion 56 of the lower component 34 of the magazine 12 to a spring catch 60. The spring catch 60 provides for a user to secure the follower 58 and compressed spring 50 in the cartridge cavity 46. When the lower component 34 of the magazine 12 is in the closed position, a user unlatches the spring catch 60 to release the cord such that the spring 50 uncompresses and the follower 58 moves into the internal cavity 38 of the upper component 32 of the magazine 12, such that cartridges 26 are urged to a point adjacent to the chamber of the barrel 16.

Optionally (as shown in FIGS. 9A, 9B and 10), a longer cord 62 may be used that travels a more circuitous route such that the spring catch 60 may be located at a desirable position on the magazine 12. Here, a duct 76 may be provided in the lower component 34 for the cord 62 such that the cord 62 does not interfere with any cartridges located in the lower component 34 of the magazine 12. Optionally, sealed bearings 78 may be placed at high friction points to provide for smooth travel and wear resistance of the cord 62 when tension is placed on the cord 62. The cord 62 travels from the aperture 70 on the follower 58 down, within the center of the spring, to the lower end 56 of the lower component 34, exiting the cartridge cavity 46, and entering the duct 76. The cord 62 travels back up the lower component 34, to a position adjacent to the top 80 of the lower component 34. The cord 62 then goes down to a lever 82, graspable by a user, that slides up (direction B of FIG. 9A) and down (direction C of FIG. 9) a slot 84 along the back surface 86 of the lower component 34. When the lever 82 is moved downward it pulls the cord 62 with it and compresses the spring 50 along with the follower 58. As can be seen in FIGS. 9C and 9D, the lever 82 may be latched at the end of the slot 84 by displacing the lever 82 laterally, such that the lever 82 is held from slipping back under the tension caused by the spring 50. With the lower component 34 in its fixed compressed state, the lower 34 component can be opened relative to the upper component 36 by releasing the lever 82. The cartridge cavity 46 above the follower 46 is available for cartridge 26 reloading. After reloading cartridges, the lower component 34 is closed relative to the upper component 32 and the lever 82 is released. The top-most cartridge 26A is advanced and restrained within feeding lips 42, and is available for chambering and firing. As each cartridge is spent, the spring advances the next cartridge 26 up until the fixed magazine is empty. The reloading process can be repeated as needed.

Figure 11:
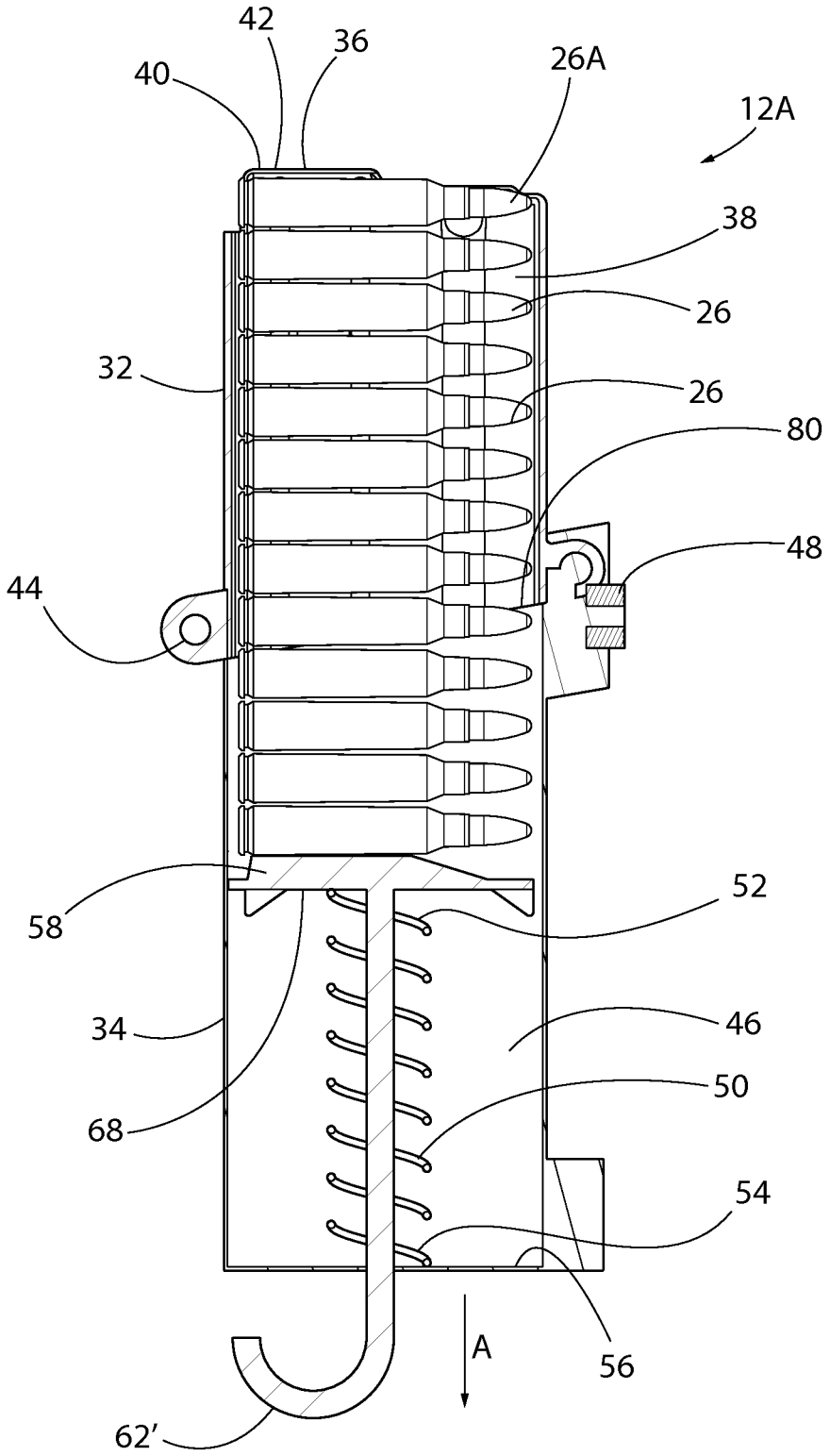
FIG. 11 is a cross sectional side view of an alternate magazine in accordance with an exemplary embodiment of the present invention.

Variations of the magazine are intended to be within the scope of the present invention. For example, a simpler magazine 12A of FIG. 11 is shown wherein no spring catch is used. A user pulls cord 62' (cable, wire, etc.) for reloading of cartridges. The cord 62 travels straight down from the follower and out the lower component 34 of the magazine 12 such that a user can apply direct downward tension on the cord 62 (direction A in FIG. 11).

Figure 13:
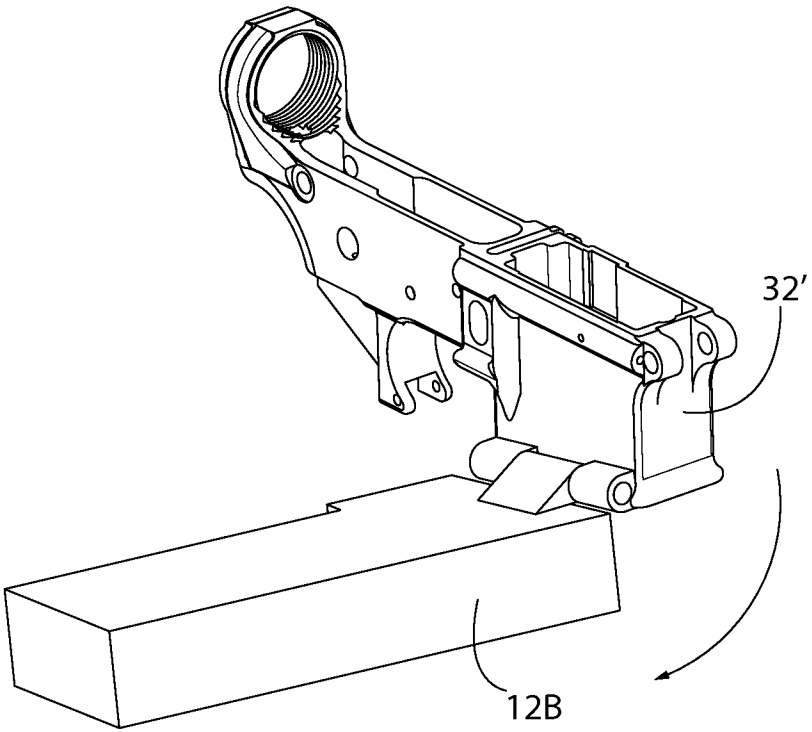
FIG. 13 is an isometric view of the alternate receiver assembly and magazine of FIG. 12, shown in an open position.
Figure 12:
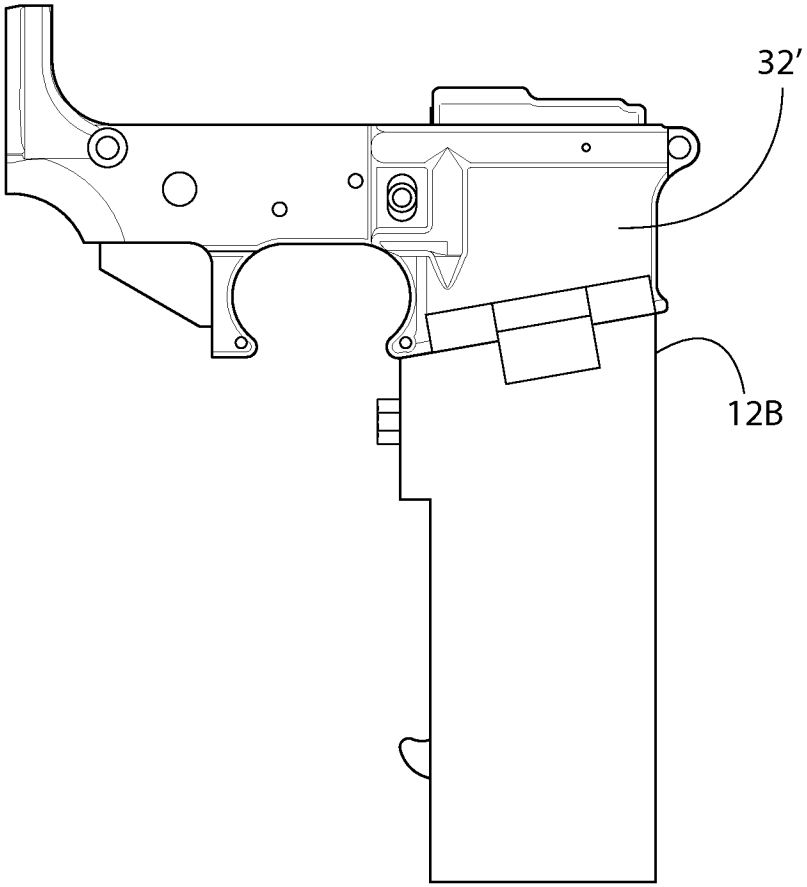
FIG. 12 is a side view of an alternate receiver assembly and magazine in accordance with another exemplary embodiment of the present invention, shown with the magazine in a closed position, ready for firing.
Figure 15:
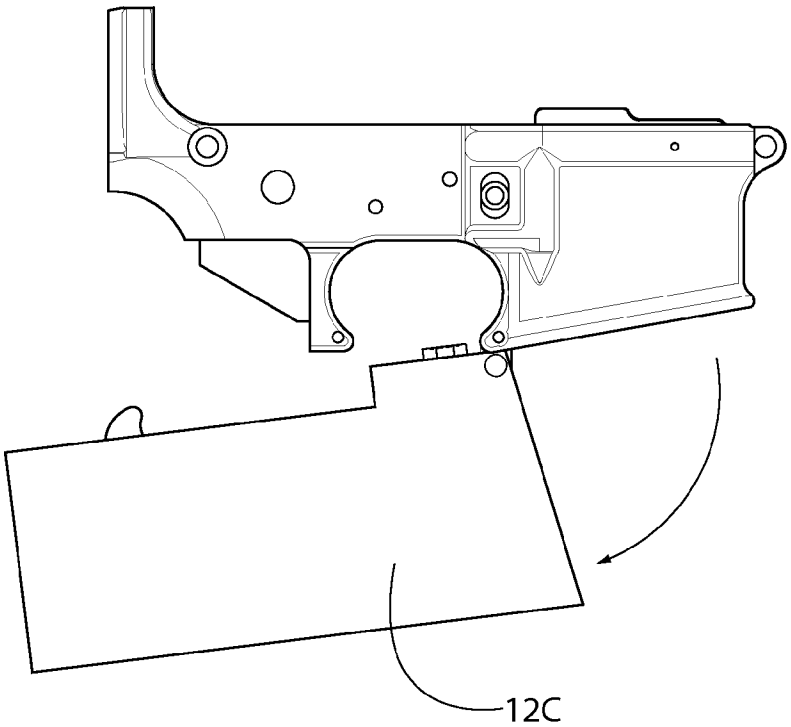
FIG. 15 is an isometric view of the alternate receiver assembly and magazine of FIG. 14, shown in an open position.
Figure 14:
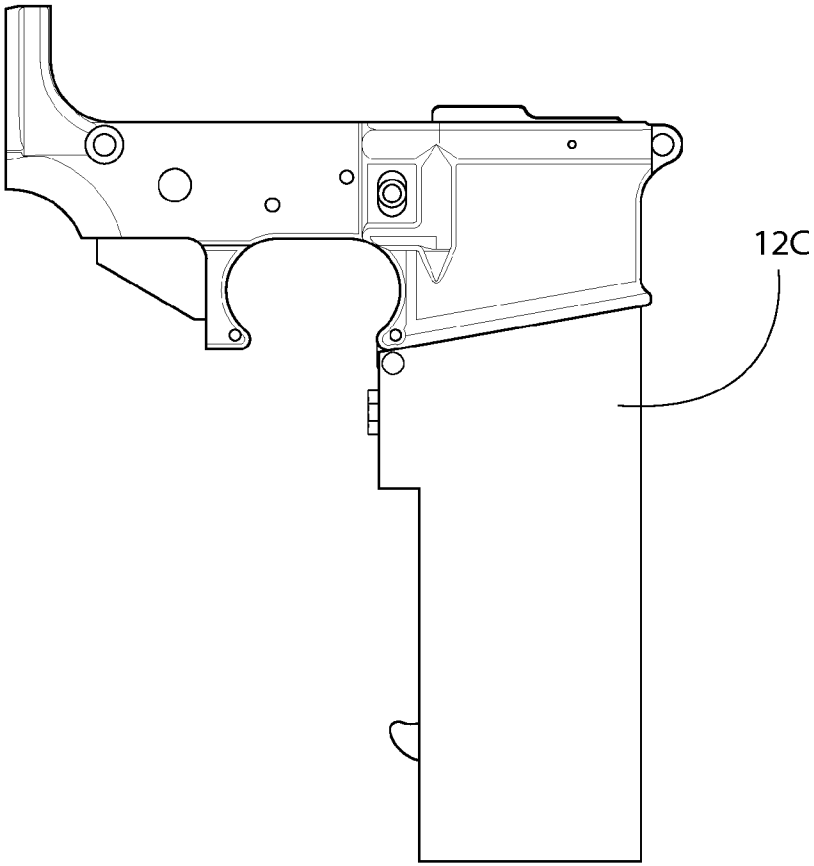
FIG. 14 is a side view of another alternate receiver assembly and magazine in accordance with another exemplary embodiment of the present invention, shown with the magazine in a closed position, ready for firing.

FIGS. 12-13 and 14-15 show two magazines 12B and 12C, respectively, having different hinge points for the upper and lower components, including magazine 12B having a sideways articulating magazine, and magazine 12C of FIGS. 14-15 having a rearward articulating magazine. In the embodiment of FIGS. 12 and 13, the upper component 32' is integral with the receiver. That is, this design is not intended for retrofit into an existing firearm.

Figure 17:
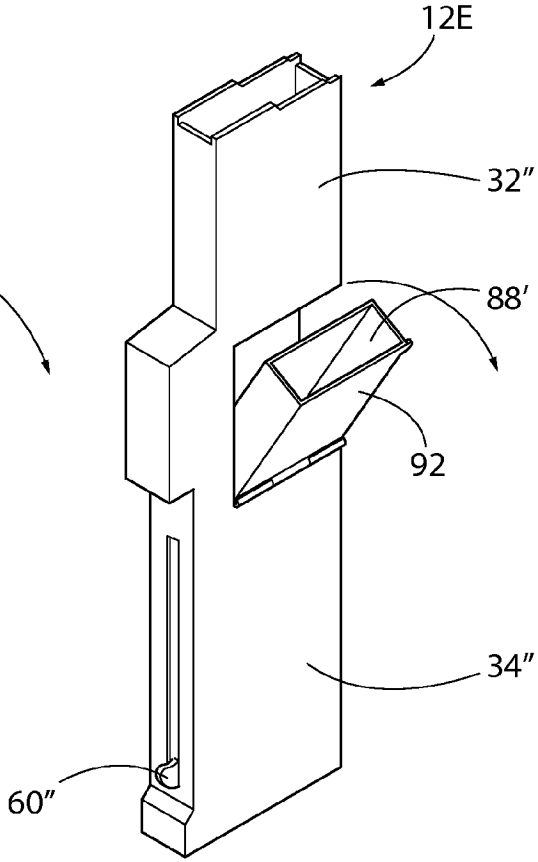
FIG. 17 is another simplified isometric view of an alternate magazine in accordance with another exemplary embodiment of the present invention.
Figure 16:
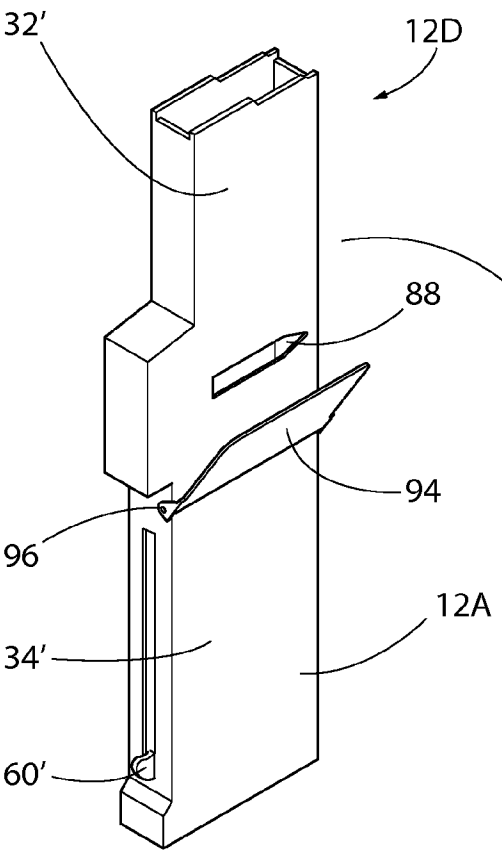
FIG. 16 is a simplified isometric view of an alternate magazine in accordance with another exemplary embodiment of the present invention.

Other embodiments are intended to be within the scope of the present invention and can be seen in FIGS. 16 and 17. In these embodiments, the magazine 12D, 12E remains permanently secured to the receiver as in the previous embodiments. In FIG. 16, the magazine 12D has a lower component 34' and an upper component 32' that are integral to one another such that both components are a single integral article (or, however, the upper component can be made of discrete components that are integral to one another). The upper component may be integral with the receiver assembly, as in previous embodiments. Rather than accessing the cartridge cavity of the lower component by rotating the lower component with respect to the upper component about the hinge as in the first embodiment, an aperture 88 in one of the sides of the lower component 34' of the magazine 12D provides an access point for cartridges to be fed, one at a time, into the cartridge cavity of the lower component 34'. The aperture 88 may be on any of the sides of the lower component 34'. Here, similar to that of the first embodiment, a spring and follower are provided for urging cartridges in the magazine towards the chamber of the barrel. For reloading, the spring and follower (not shown, but are substantially the same as that of the previously described embodiment of the firearm 10) are captured entirely within the lower component 34'. A catch 60', for example, the spring catch and cord arrangement of the first embodiment, may be included. A hinged cover 94 rotatable about hinge 96 may be used to close the aperture 88, as shown in FIG. 16.

A variation, of the magazine 12D of FIG. 16 is shown in FIG. 17. This magazine 12E, adds a hinged channel 92 for assistance in loading cartridges. To reload, the spring and follower are held by the spring catch 60" entirely within the lower component 34" and, subsequently, the hinged channel 92 is rotated to an open position at hinge 96' (shown in the open position in FIG. 17). One at a time, cartridges are placed in the aperture 88' in the channel 92 and, when fully reloaded, the channel 92 is rotated back to its closed position such that the channel 92 forms a part of the cartridge cavity of the lower component 34". The catch is released such that the cartridges are urged by the spring driven follower through the upper component 32" toward the chamber of the barrel. See previous embodiments for further details of these features.

Figure 2:
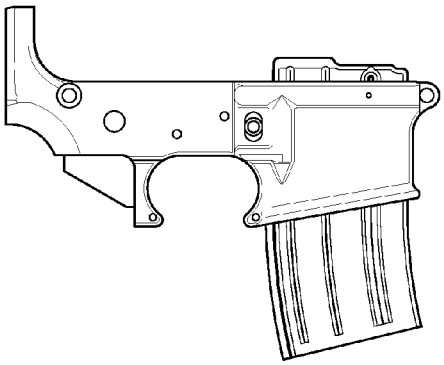
FIG. 2 (PRIOR ART)
FIG. 2 is a side view of a portion of a prior art receiver assembly and magazine, shown with the magazine installed on the receiver assembly.
Figure 3:
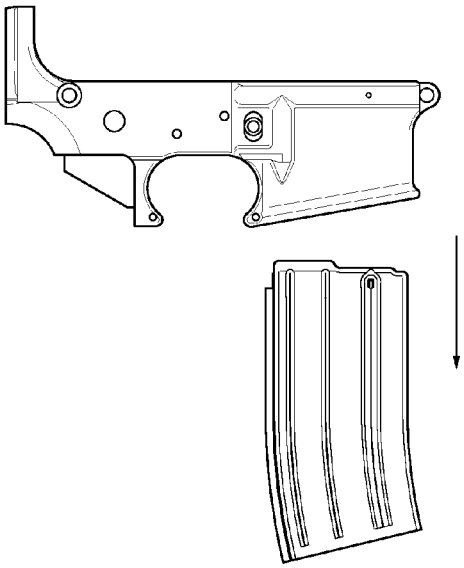
FIG. 3 (PRIOR ART)
FIG. 3 is a side view of the portion of the prior art receiver assembly and magazine of FIG. 2, shown with the magazine uninstalled from the receiver assembly.

In any of the above embodiments, it is intended that the magazine may be a separate integral structure that mates with and permanently mounts to a standard receiver in the receiver assembly 14 of the firearm 10. That is, the magazine retrofits firemarms having removable magazines, such as those seen in FIGS. 2-4. See, for example, FIGS. 5-8, 9A, 9B, 10, and 11. Alternatively, the magazine 12B and receiver 30 may be a single, integral unit that is integral and unremovable from the receiver assembly of the firearm 10. That is, it is contemplated that a firearm that has been designed or redesigned to include a permanent magazine that is integral with its receiver assembly (i.e., not a retrofit for existing firearms) is within the scope of the present invention. See, for example, FIGS. 12-17.

While the invention has been described in detail and with reference to specific embodiments thereof, it will be apparent to one skilled in the art that various changes and modifications can be made therein without departing from the spirit and scope thereof.

What is claimed is:

1. A firearm having a permanently affixed magazine, comprising:

(a) a receiver assembly having a barrel end, a butt end, a top, and a receiver end;

(b) a barrel affixed to the barrel end of the receiver assembly, said barrel having a chamber for receiving cartridges;

(c) a receiver disposed on the receiver end of the receiver assembly; and (d) the magazine for storing and feeding cartridges into the chamber of the barrel, said magazine permanently secured to the receiver, the magazine comprising:

(i) an upper component disposed in the receiver, having an open feed end disposed adjacent to the chamber of the barrel for feeding cartridges to the chamber and an internal cavity for receiving cartridges;

(ii) a lower component integral to the upper component, such that cartridges may pass from a cartridge cavity of the lower component to the internal cavity of the upper component;

(iii) an aperture in the lower component of the magazine for feeding cartridges into the magazine;

(iv) a hinged channel for accessing the aperture for feeding cartridges into the magazine, the hinged channel having an upper end and a lower end and moveable from a closed position wherein the hinged channel forms a portion of the cartridge cavity of the lower component, to an open position wherein the upper end of the hinged channel is accessible to provide for a user to feed cartridges through the aperture into the lower component of the magazine; and (v) a spring for urging cartridges in the magazine towards the chamber of the barrel, said spring having a first end disposed against a lower end of the lower component of the magazine, and a second end disposed against a follower wherein the spring is at least partially uncompressed and extends through the cartridge cavity of the lower component of the magazine and through the internal cavity of the upper component, wherein, upon firing of the firearm, a topmost cartridge of the plurality of cartridges is urged towards the chamber for feeding into the chamber, wherein the spring is capturable entirely within the lower component of the magazine, wherein the magazine is accessible for reloading of cartridges through the aperture.

2. The firearm having a permanently affixed magazine of claim 1, including a spring catch to releasably secure the spring and follower within the lower component of the magazine such that the lower component is reloadable with cartridges, and, when the spring and follower are not secured by the spring catch, the spring is at least partially uncompressed such that the follower is urged by the spring into the upper component of the magazine.

3. The firearm having a permanently affixed magazine of claim 2, including a substantially inelastic cord having a first end and a second end, said first end secured to the follower, said second end adapted to be pulled to place tension on the cord in a direction to cause the follower to retract into the cartridge cavity of the lower component.

4. The firearm having a permanently affixed magazine of claim 3, wherein the cord extends from the follower to a lower portion of the lower component of the magazine to a spring catch to removably secure the follower in the cartridge cavity, wherein the spring catch is releasable such that the spring is at least partially uncompressed and the follower is moveable within the upper portion of the magazine to a point adjacent to the chamber.

5. The firearm having a permanently affixed magazine of claim 4, wherein the cord extends from the follower to the lower portion of the cavity up to an upper end of the lower portion to the spring catch.

6. A magazine for storing and feeding cartridges into a chamber of a firearm, comprising:

(a) an upper component having an open feed end disposed for feeding cartridges and an internal cavity for receiving cartridges; and (b) a lower component integral to the upper component, such that cartridges may pass from a cartridge cavity of the lower component to the internal cavity of the upper component;

(c) an aperture in the lower component of the magazine for feeding cartridges into the magazine;

(d) a hinged channel for accessing the aperture for feeding cartridges into the magazine, the hinged channel having an upper end and a lower end and moveable from a closed position wherein the hinged channel forms a portion of the cartridge cavity of the lower component, to an open position wherein the upper end of the hinged channel is accessible to provide for a user to feed cartridges through the aperture into the lower component of the magazine; and (e) a spring for urging cartridges in the magazine towards the open feed end of the magazine, said spring having a first end disposed against a lower end of the lower component of the magazine, and a second end disposed against a follower wherein the spring is at least partially uncompressed and extends through the cartridge cavity of the lower component of the magazine and through the internal cavity of the upper component, wherein, upon firing of the firearm, a topmost cartridge of the plurality of cartridges is urged towards the open feed end of the magazine, wherein the spring is capturable entirely within the lower component of the magazine, wherein the magazine is accessible for reloading of cartridges through the aperture.

7. The magazine of claim 6, including a spring catch to releasably secure the spring and follower within the lower component of the magazine such that the lower component is reloadable with cartridges, and, when the spring and follower are not secured by the spring catch, the spring is at least partially uncompressed such that the follower is urged by the spring into the upper component of the magazine.

8. The magazine of claim 7, including a substantially inelastic cord having a first end and a second end, said first end secured to the follower, said second end adapted to be pulled to place tension on the cord in a direction to cause the follower to retract into the cartridge cavity of the lower component.

9. The magazine of claim 8, wherein the cord extends from the follower to a lower portion of the lower component of the magazine to a spring catch to removably secure the follower in the cartridge cavity, wherein the spring catch is releasable such that the spring is at least partially uncompressed and the follower is moveable within the upper portion of the magazine to the open feed end of the magazine.

10. The magazine of claim 9, wherein the cord extends from the follower to the lower portion of the cavity up to an upper end of the lower portion to the spring catch.

* * * * *